US006955346B2

(12) United States Patent
Anderson

(10) Patent No.: US 6,955,346 B2
(45) Date of Patent: Oct. 18, 2005

(54) ADJUSTABLE LOCATOR FOR ASSEMBLY OF TRUSSES

(75) Inventor: William W. Anderson, Edenton, NC (US)

(73) Assignee: Mitek Holdings, Inc., Wilmington, DE (US)

( * ) Notice: Subject to any disclaimer, the term of this patent is extended or adjusted under 35 U.S.C. 154(b) by 70 days.

(21) Appl. No.: 10/417,063

(22) Filed: Apr. 16, 2003

(65) Prior Publication Data

US 2004/0206019 A1 Oct. 21, 2004

(51) Int. Cl.[7] ..... B25B 1/20

(52) U.S. Cl. ..... 269/303; 269/910; 269/289; 29/281.3; 29/281.4; 29/281.1; 52/127.1; 52/127.2; 52/127.5; 52/127.6; 52/754.19

(58) Field of Search ..... 52/127.1–127.2, 52/127.5, 127.6, 127.7, 127.8, 633, 690, 634, 745.19; 29/281.1, 281.4, 281.3, 897, 700, 897.3, 897.31, 897.312, 407.09, 407.1, 428, 203–206, 208; 269/236, 234, 307, 303, 305, 99, 910, 289

(56) References Cited

U.S. PATENT DOCUMENTS

| | | | | |
|---|---|---|---|---|
| 3,212,694 A | | 10/1965 | Sanford | |
| 3,238,867 A | | 3/1966 | Jureit et al. | |
| 3,241,585 A | | 3/1966 | Jureit | |
| 3,255,943 A | | 6/1966 | Sanford | |
| 3,367,010 A | | 2/1968 | Lytle et al. | |
| 3,667,379 A | | 6/1972 | Templin | |
| 3,925,870 A | * | 12/1975 | Adams | 100/161 |
| 4,024,809 A | * | 5/1977 | Moehlenpah | 100/100 |
| 4,044,093 A | * | 8/1977 | Jureit et al. | 269/111 |
| 4,524,960 A | * | 6/1985 | LePoire | 269/45 |
| 4,679,781 A | * | 7/1987 | LePoire | 269/45 |
| 5,361,495 A | * | 11/1994 | Pyle et al. | 29/897.31 |
| 5,385,339 A | | 1/1995 | Williams | |
| 5,608,970 A | | 3/1997 | Owen | |
| 5,702,095 A | | 12/1997 | Williams | |
| 5,810,341 A | | 9/1998 | Williams | |
| 5,816,300 A | | 10/1998 | Rogers | |
| 5,837,014 A | | 11/1998 | Williams | |
| 5,854,747 A | | 12/1998 | Fairlie | |
| 5,867,905 A | * | 2/1999 | Whale et al. | 29/897.31 |
| 5,941,514 A | * | 8/1999 | Burcaw | 269/37 |
| 6,079,325 A | | 6/2000 | LePoire et al. | |
| 6,155,549 A | * | 12/2000 | Burcaw | 269/37 |
| RE37,797 E | | 7/2002 | Haase | |

* cited by examiner

*Primary Examiner*—Jeanette E Chapman
(74) *Attorney, Agent, or Firm*—Senniger Powers

(57) ABSTRACT

A locator for locating and holding a structural member in engagement with an adjacent structural member at a predetermined position of an assembly apparatus during a truss assembly operation. The locator includes a cylindric sleeve having an outer wall configured for engaging the structural member and a bore extending through the sleeve defining an inner wall sized for placement around a stop of the assembly apparatus. The bore is eccentrically positioned in the sleeve. The sleeve is portable, may be secured to the apparatus free from fixed connection, and is rotatable about the stop for adjusting a magnitude of force applied by the sleeve to the structural member.

13 Claims, 3 Drawing Sheets

ADJUSTABLE LOCATOR FOR ASSEMBLY OF TRUSSES

BACKGROUND OF THE INVENTION

This invention relates generally to the assembly of trusses, and in particular to a locator for holding a structural member at a predetermined position on an assembly apparatus.

Pre-manufactured structural frameworks, such as trusses, are widely used in the construction industry for forming a roof, wall panel, floor, or other building component. Each truss includes a collection of structural members, typically in the form of wooden timbers, held together by connectors, such as connector ("nailing") plates pressed into the timbers. The truss is assembled to the correct specifications at a factory and then shipped to a construction site. A gantry press apparatus is frequently used to facilitate efficient assembly of the truss. It features a table on which the timbers and connector plates are placed at desired relative positions to form the particular truss configuration.

Conventionally, the table has cylindrically-shaped stops (often referred to as "pucks") for setting positions of timbers. The stops are slidable along spaced opening channels in the table and are locked at predetermined positions in the channels dependent upon the shape of the truss which is required. The timbers are then located against the stops to define the shape of the truss. Connector plates are placed at locations where adjacent timbers intersect. A motorized roller apparatus (i.e., the gantry) then travels along the table to press integral teeth of the connector plates into the timbers thereby joining them together.

Ideally, each timber should be in tight abutment against adjacent timbers when placed on the table so that the assembled truss will be strong and loads will be effectively transferred between the timbers making up the truss. Unfortunately, some timbers have imperfections, nonlinearities, or warp which form one or more gaps between adjacent structural members or between a stop and a structural member. If not eliminated, these gaps would substantially degrade the strength of the assembled truss.

Typically, an operator visually inspects an assembly of structural members prior to activating the roller apparatus. Upon discovering a gap, the operator inserts a wooden wedge between a stop and timber to press the timber into firm engagement with an adjacent timber. Unfortunately, these actions are detrimental to an efficient assembly process and can cause substantial downtime. Wedges are prone to slip or break during installation, fall to the floor at a location from which retrieval is difficult, or be inadvertently nailed into assembly with the truss.

Consequently, some systems of the prior art have featured devices for pressing timbers against adjacent timbers to eliminate gaps. However, these devices have been complex or have been fixedly attached to the apparatus such that it is time consuming to move the device to a second location where gapping occurs, or to another, similar apparatus.

SUMMARY OF THE INVENTION

Among the several objects and features of the present invention may be noted the provision of a locator for pressing a structural member into engagement with an adjacent structural member; the provision of such a locator which is adjustable for applying a pressing force of variable magnitude; the provision of such an apparatus which is readily portable for use at a second location; the provision of such a locator which fits upon existing equipment; and the provision of such a locator which is inexpensive to manufacture.

In general, a portable locator according to the present invention locates and holds a structural member in a predetermined position on a worksurface of an assembly apparatus during an assembly operation wherein at least one fastener is installed to connect the structural member to another structural member. The locator comprises a body configured for securement to the assembly apparatus free from fixed connection thereto at a first installed position from which the body may engage the structural member to press against the structural member for use in holding the structural member at its predetermined position on the worksurface. The body is adapted to be freely removed from the first installed position without releasing any fixed connection for movement to a second installed position on the assembly apparatus for ready securement thereto free from fixed connection.

In another aspect, an extender according to the present invention is for a stop of an assembly apparatus. The extender presses a structural member into engagement with an adjacent structural member at a predetermined position on a worksurface of the assembly apparatus during an assembly operation wherein at least one fastener is installed to connect the structural members at the predetermined position. The stops project above the worksurface for guiding positions of the structural members. The extender comprises a sleeve sized and shaped for placement at an installed position generally around one of the stops and extending a lateral reach of the stop. The sleeve has an inner wall for engaging the stop and an outer wall for engaging the structural member and applying force thereto. The sleeve defines a radial thickness disposed between the inner and outer walls. The inner wall is eccentrically positioned relative to the outer wall such that the radial thickness varies in a circumferential direction around the sleeve. The sleeve is rotatable about the stop such that rotation of the sleeve alters the radial thickness of sleeve positioned between the stop and structural member to thereby adjust a magnitude of force applied by the sleeve to the structural member.

Other objects and features of the present invention will be in part apparent and in part pointed out hereinafter.

BRIEF DESCRIPTION OF THE DRAWINGS

Corresponding reference characters indicate corresponding parts throughout the views of the drawings.

DETAILED DESCRIPTION OF THE PREFERRED EMBODIMENT

Figure 1:
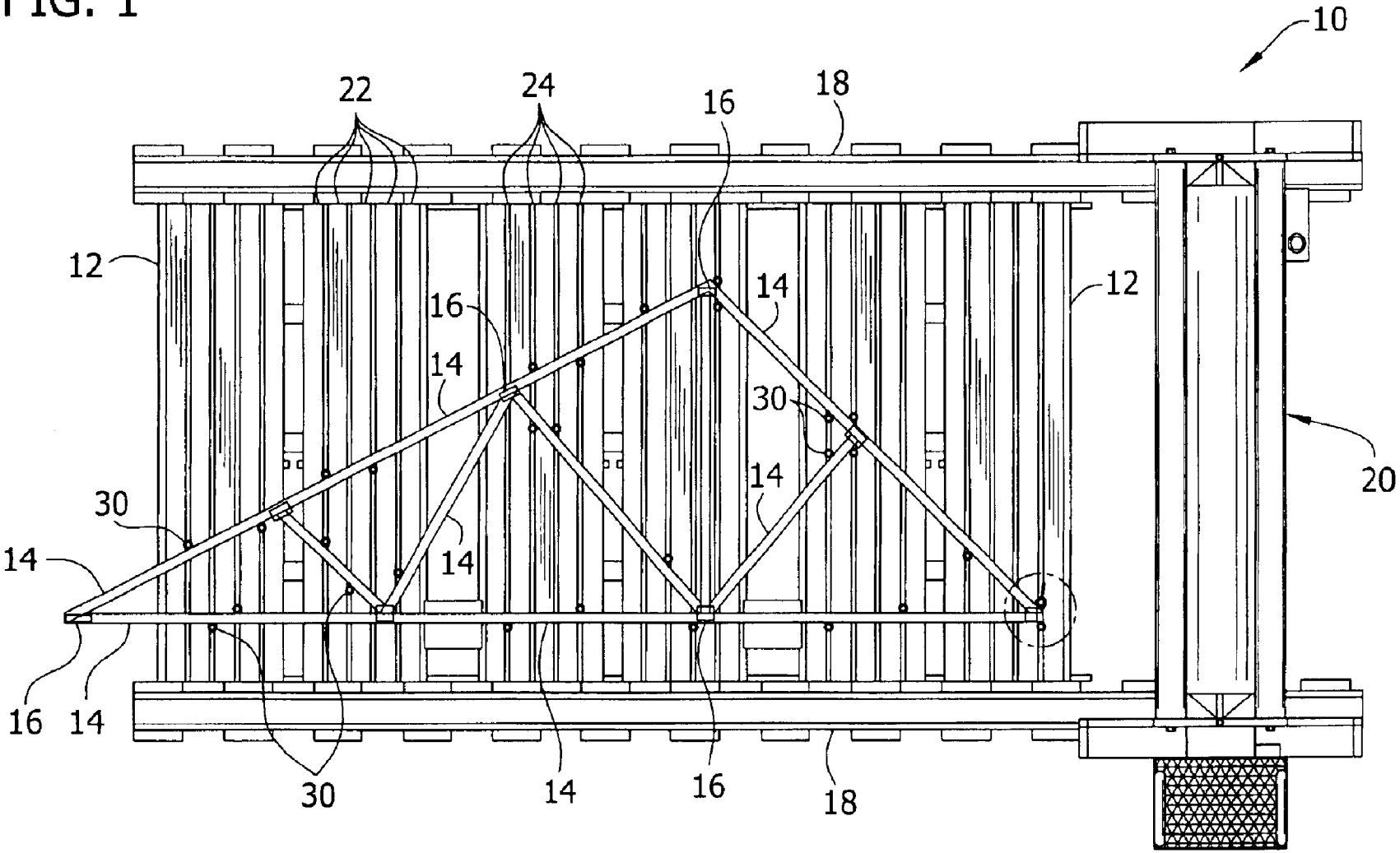
FIG. 1 is a top plan of a truss assembly apparatus with structural members arranged for assembly.

Referring now to the drawings and in particular to FIG. 1, a truss assembly apparatus according to the present invention is indicated generally at 10. The apparatus 10 includes a truss table 12 on which structural members 14 and connector plates 16 may be positioned at a desired configuration for assembly to form a truss. Outer rails 18 are provided for guiding movement of a roller assembly 20 relative to the truss table 12 to press connector plates 16 into the structural members 14 to connect the structural members.

In the illustrated embodiment, the structural members 14 are wooden timbers, but they could be made of other materials (e.g., plastic, steel, etc.) without departing from the scope of the present invention.

The truss table 12 has a plurality of parallel, elongate panels 22 providing a worksurface for placement of timbers 14. A slot 24 is left between adjacent pairs of panels 22 suitable for placement of conventional positioning stops 30. Each stop is slidable in translation along the slot 24 and is capable of being fixed along the slot for correct location and placement of timbers 14 on the worksurface to form a truss. The stops 30 project above the worksurface for guiding positions of the timbers 14. Typically, each stop 30 has a cylindric shape.

Because the truss assembly apparatus 10 is conventional, it will not be described in further detail. Reference is made to co-pending U.S. patent application Ser. No. 10/233,034, filed Aug. 30, 2002 and entitled "Truss Assembly Apparatus," which is hereby incorporated by reference, and to the following U.S. Patents for further background regarding truss assembly systems, each of which is also hereby incorporated by reference:

| Patent No. | Date | Title |
|---|---|---|
| 5,385,339 | Jan. 31, 1995 | Set-Up Jig For Truss Table |
| 5,702,095 | Dec. 30, 1997 | Truss Table with Integrated Positioning Stops |
| 5,810,341 | Sep. 22, 1998 | Truss Table with Integrated Positioning Stops |
| 5,837,014 | Nov. 17, 1998 | Truss Table with Integrated Positioning Stops |
| 6,079,325 | Jun. 27, 2000 | Trackless Gantry Press System |
| Re 37,797 | Jul. 23, 2002 | Truss Assembly Apparatus with Independent Roller Drive |

Figure 4:
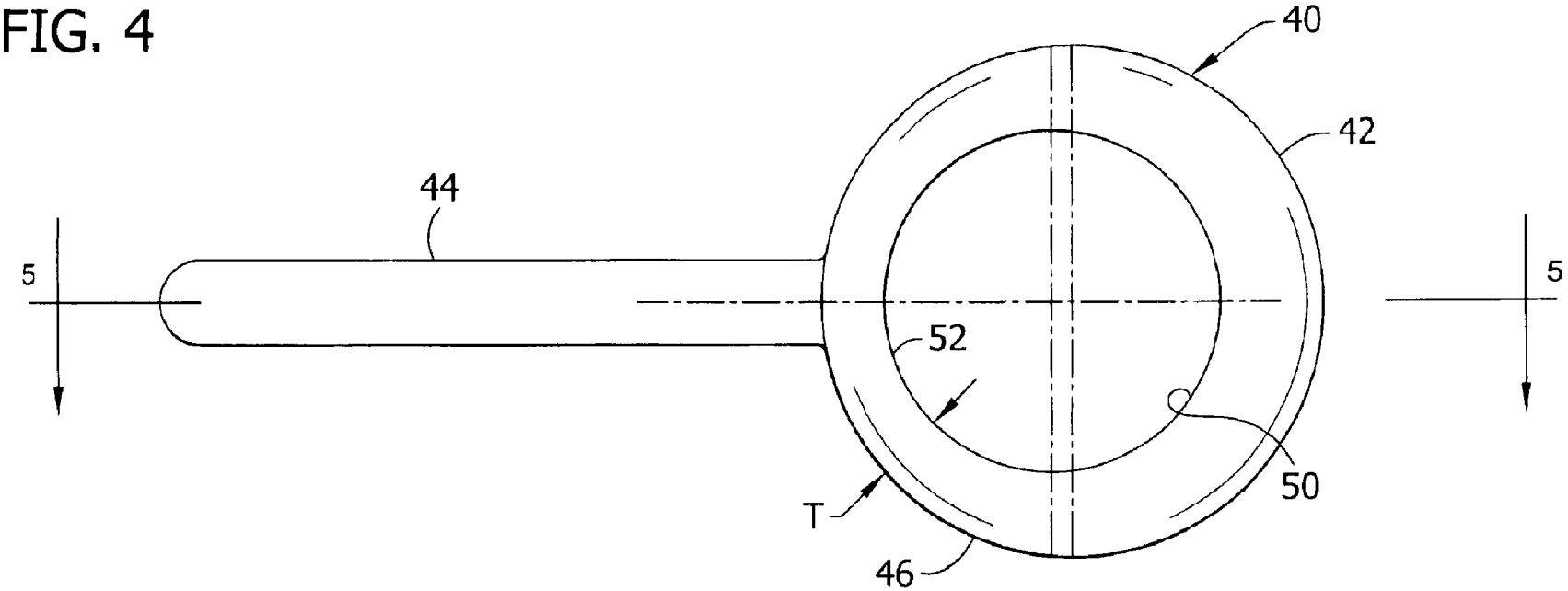
FIG. 4 is a top plan view of the adjustable locator.
Figure 5:
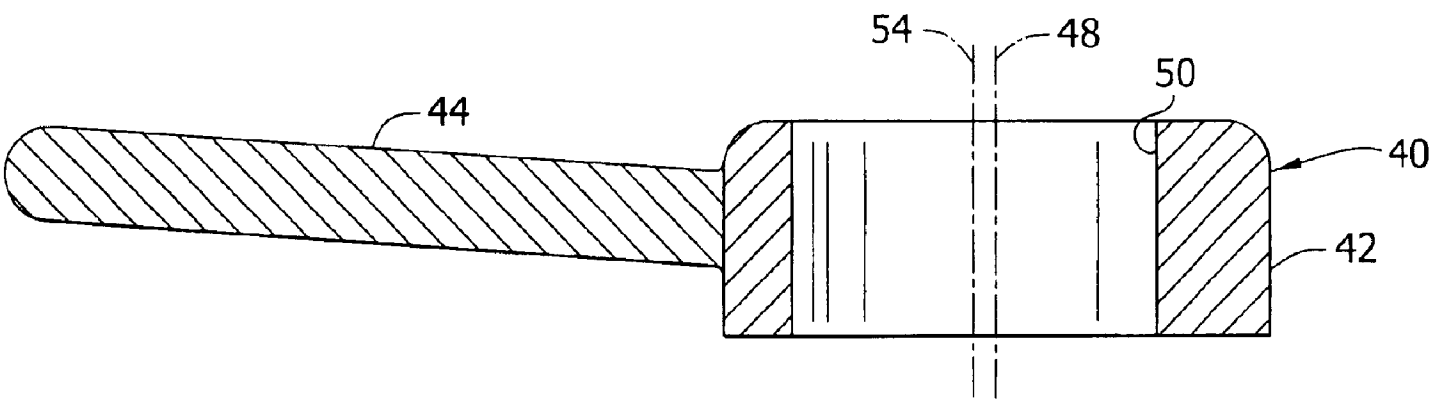
FIG. 5 is a section on line 5—5 of FIG. 4.

A portable locator according to the present invention, indicated generally at 40, is used with the truss assembly apparatus 10 for locating and holding a timber 14 in engagement with an adjacent timber. Referring to FIGS. 4 and 5, the locator 40 has a low-profile cylindric sleeve 42 (broadly, a "body") and a handle 44 secured to the sleeve for manually raising, lowering, and rotating the sleeve. The sleeve 42 has an outer wall 46 for engaging the timber and a first central axis 48 associated with the sleeve and the outer wall. The first central axis 48 extends along the axis of rotation of a cylinder defined by the outer wall 46.

An opening 50 extends through the sleeve 42 which is eccentrically positioned relative to the outer wall 46 of the sleeve. The opening 50 is defined by a cylindric bore forming an inner wall 52. The opening 50 and inner wall 52 are associated with a second central axis 54 extending along the axis of rotation of a cylinder defined by the inner wall. The opening 50 has a size and shape corresponding with one of the stops 30 such that the sleeve 42 may be secured at an installed position (FIG. 2) on the apparatus 10 by lowering the sleeve and placing it around the stop with the stop being received in the opening of the sleeve. The inner wall 52 of the sleeve is adjacent to the stop 30 (either engaging or closely spaced with the stop). For example, for use with a conventional cylindric stop with an external diameter of 2.00 inches, the opening 50 is defined by a cylindric bore having a diameter of 2.01 inches. The slightly larger diameter of the bore facilitates slidable movement of the inner wall 52 relative to the stop 30 while still maintaining the sleeve 42 firmly secured to the stop. Preferably, the sleeve 42 and opening 50 have heights which are approximately the same as the height of a stop 30 (1.14 inches in the preferred embodiment) to completely cover the stop. However, the heights of the sleeve and stop may be different from each other. The opening 50 extends completely through an entirety of the sleeve 42, although it is understood that a sleeve with an opening which extends only partially through the sleeve, or has a non-circular inner or outer wall, does not depart from the scope of this invention.

The first and second axes 48, 54 are parallel and non-coincident such that the opening 50 is eccentrically positioned in the sleeve 42 relative to a center of the sleeve and the outer wall 46. Consequently, the sleeve 42 has a radial thickness T (FIG. 4) between the inner and outer walls 52, 46 which varies in a circumferential direction around the sleeve. Although in the preferred embodiment, the opening 50 is enclosed within the sleeve 42 (i.e., positioned within the outer wall 46), the opening could be positioned such that it removes a portion of the outer wall and forms an open crescent-shaped notch (not shown) in one side of the sleeve.

Figure 3:
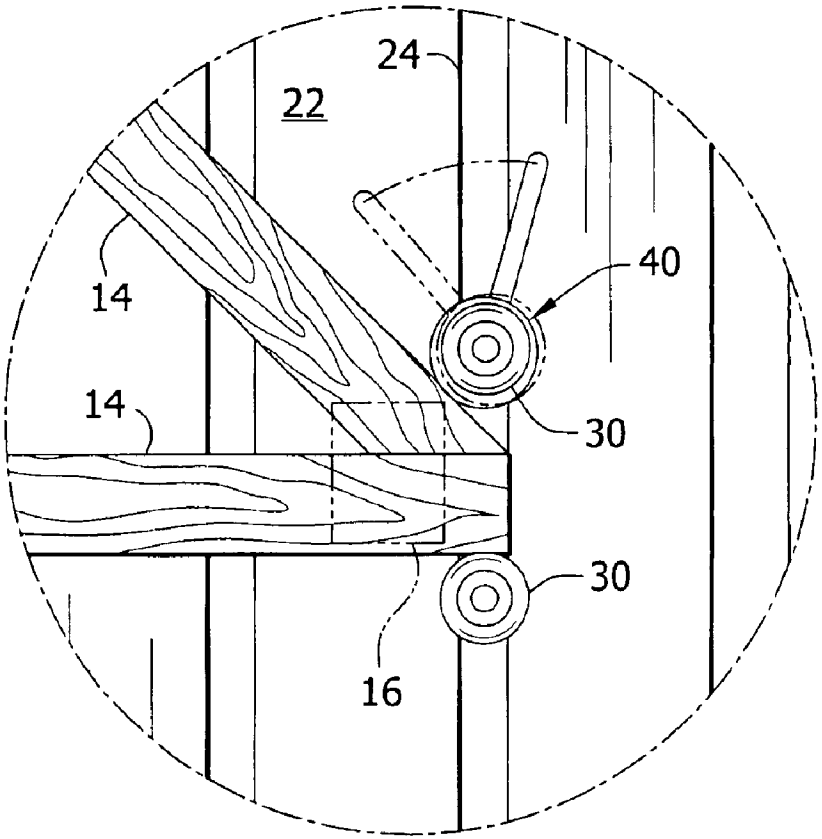
FIG. 3 is a view similar to FIG. 2 with the locator rotated to an extended orientation for pressing a structural member against an adjacent structural member, a retracted orientation being shown in phantom.
Figure 2:
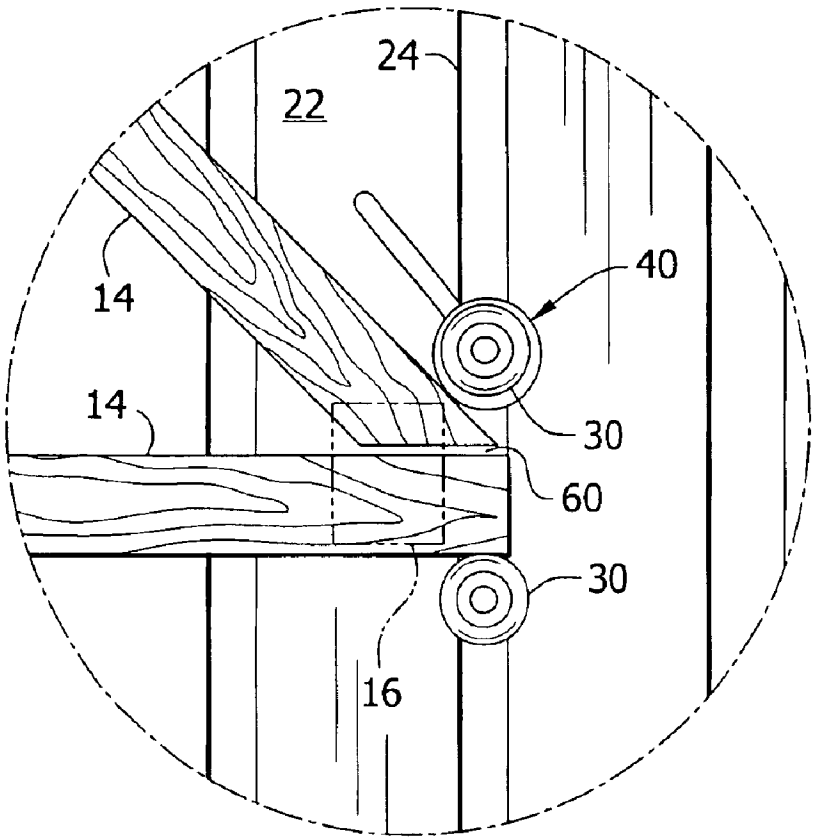
FIG. 2 is an enlarged fragment of FIG. 1 showing an adjustable locator of the present invention at an installed position on the apparatus.

At the installed position (FIGS. 2 and 3), the sleeve 42 generally encircles the stop 30 and the radial thickness is disposed between the stop and the timber 14. The sleeve 42 is rotatable relative to the apparatus 10 with a center of rotation defined by the second axis 54. As shown in FIG. 2, a gap 60 is formed between a timber 14 and an adjacent timber. The gap may have any size, including a very small size, and may be found between edges of timbers which are parallel (as in FIG. 2) or non-parallel. The stop 30 with sleeve 42 may be slid along its slot 24 for proper positioning, if needed, and secured at a different location. Rotation of the sleeve 42 adjusts the radial thickness of the sleeve positioned between the stop 30 and the timber 14 to thereby adjust the magnitude of force with which the sleeve presses the timber against the adjacent timber. After rotation (FIG. 3), a portion of the sleeve 42 having a greater radial thickness is positioned between the stop 30 and timber 14 and consequently the gap 60 is eliminated. Thus the locator 40 functions as a cam for guiding positions of timbers. The angle of rotation corresponds with a magnitude of force applied to the timber 14 and the distance the timber is moved. Accordingly, the sleeve 42 is rotated until the timber 14 firmly abuts the adjacent timber. It is understood that locators which are not rotatable do not depart from the scope of this invention.

Significantly, the sleeve 42 may be secured to the apparatus 10 free from fixed connection. Thus the locator is fully portable and may be quickly installed and used by placing it on a stop 30. Subsequent to the assembly operation, the sleeve 42 may be freely removed from the installed position without releasing any fixed connector for movement to a second installed position on the apparatus or to a second assembly apparatus for ready securement thereto free from fixed connection.

The locator 40 is formed of a suitable strong and rigid material. In the preferred embodiment, the locator is made of cold rolled, AISI-SAE 1018 steel, although other materials, including non-metallic materials, do not depart from the scope of this invention. The locator 40 is manufactured by slicing a segment from a solid round shaft. That shaft segment forms the sleeve 42, and a hole is drilled through the segment forming the opening 50. A lathe or a CNC milling machine may be used to improve the circularity of the sleeve 42 and opening 50 and any sharp corners may be rounded. The handle 44 is a solid rod of length suitable for gripping and is secured to the sleeve 42 such as by welding. For ease of use, the handle 44 is preferably attached in a radial direction relative to the sleeve 42 and at a slight upward angle of inclination in a direction moving away from the sleeve, such as four degrees. Other handle orientations and sleeves without handles do not depart from the scope of this invention.

In an alternate embodiment (not shown), the sleeve 42 may be more permanently secured to a stop 30 for repeated uses therewith. The inner wall 52 is modified to include an engagement surface (not shown) such as an annular, vertically-facing shoulder or lip. The stop 30 is modified with a corresponding engagement surface such as a circumferential shoulder or groove. The locator and stop may be joined together into an assembled unit with the corresponding surfaces in engagement. The assembled unit may then be slid along channels in the table or locked at a predetermined position for repeated use in assembling trusses. The engaging surfaces do not impede rotation of the sleeve relative to the stop. Other systems for securing the sleeve and stop do not depart from the scope of this invention.

In view of the above, it will be seen that the several objects of the invention are achieved and other advantageous results obtained. The locator 40 may be used with existing equipment of a truss assembly apparatus to press a structural member into engagement with an adjacent structural member. The locator is adjustable for applying a pressing force of variable magnitude. The locator is portable, may be secured to the apparatus without fixed attachment, and is reliable in operation.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above without departing from the scope of the invention, it is intended that all matter contained in the above description and shown in the accompanying drawings shall be interpreted as illustrative and not in a limiting sense.

What is claimed is:

1. A portable locator for locating and holding a structural member in a predetermined position on a worksurface of an assembly apparatus during an assembly operation wherein at least one fastener is installed to connect the structural member to another structural member, the apparatus having stops projecting above the worksurface for locating the structural members, the locator comprising a body configured for securement to the assembly apparatus free from fixed connection thereto at a first installed position from which the body may engage the structural member to press against the structural member for use in holding the structural member at its predetermined position on the worksurface, the body being adapted to be freely removed from the first installed position without releasing any fixed connection for movement to a second installed position on said assembly apparatus for ready securement thereto free from fixed connection;

wherein the body further comprises an opening with a size and shape for receiving one of said stops such that the body is securable at either one of the first or second installed positions by placing the body around a corresponding one of said stops with the stop being received in the opening of the body, the body having a cylindrically shaped outer wall for engaging the structural member, a first central axis, and a cylindrically shaped inner wall defining said opening, the opening having a second central axis;

wherein the first and second axes are parallel and noncoincident such that said opening in the body is eccentrically positioned relative to the outer wall;

wherein the body has a radial thickness disposed between the inner and outer walls, said thickness varying in a circumferential direction around the body, and at said first or second installed position, said thickness is disposed between said stop and the structural member and corresponds with a magnitude of force applied on the structural member to press the structural member against the adjacent structural member;

wherein the body at said first or second installed position is rotatable relative to the apparatus with a center of rotation defined by the second axis;

wherein the body has a first circumferential portion positioned between the stop and structural member, and wherein rotation of the body places a second circumferential portion of the body in position between the stop and the structural member, said second portion having a different radial thickness than said first portion to thereby adjust the magnitude of force with which the body presses the structural member.

2. A portable locator as set forth in claim 1 wherein said radial thickness of the second circumferential portion is greater than said radial thickness of the first circumferential portion, and wherein the body is rotatable between an extended orientation in which said second portion is in position between the stop and the structural member and the body presses against the structural member, and a retracted orientation in which said first portion is in position between the stop and the structural member and the body does not press against the structural member.

3. A portable locator as set forth in claim 2 wherein the body is slidably secured to the assembly apparatus.

4. A portable locator as set forth in claim 3 wherein the body is slidable in translation relative to the assembly apparatus for securement and release and slidable in rotation relative to the assembly apparatus for movement between the extended and retracted orientations.

5. A portable locator as set forth in claim 4 further comprising a handle projecting outwardly from the body for moving the body.

6. A portable locator as set forth in claim 1 wherein the opening extends completely through an entirety of the body.

7. A portable locator as set forth in claim 1 in combination with the stops.

8. A portable locator as set form in claim 1 in combination with the assembly apparatus.

9. A portable locator as set forth in claim 1 in combination with at least one additional portable locator.

10. An extender for a stop of an assembly apparatus to press a structural member into engagement with an adjacent structural member at a predetermined position on a worksurface of the assembly apparatus during an assembly operation wherein at least one fastener is installed to connect the structural members at the predetermined position, the stops projecting above the worksurface for guiding positions of the structural members, the extender comprising:

a sleeve sized and shaped for placement at an installed position generally around one of said stops and extending a lateral reach of said stop, the sleeve having an inner wall for engaging the stop and an outer wall for engaging the structural member and applying force thereto, the sleeve defining a radial thickness disposed between the inner and outer walls, the inner wall being eccentrically positioned relative to the outer wall such that the radial thickness varies in a circumferential direction around the sleeve;

wherein the sleeve is rotatable about the stop such that rotation of the sleeve from a first position wherein a first circumferential portion of the sleeve having a first radial thickness is located between the stop and structural member, to a second position wherein a second circumferential portion of the sleeve having a second radial thickness different than said first radial thickness is located between the stop and structural member, thereby adjusts a magnitude of force applied by the sleeve to the structural member.

11. An extender as set forth in claim 10 further comprising a handle secured to the sleeve for rotating the sleeve.

12. An extender as set forth in claim 10 in combination with the stops.

13. An extender as set forth in claim 10 wherein the sleeve is secured at the installed position free from fixed connection to the assembly apparatus.

* * * * *